US006632010B2

(12) United States Patent
Bartos

(10) Patent No.: US 6,632,010 B2
(45) Date of Patent: Oct. 14, 2003

(54) FLUID-HOLDING APPARATUS INCLUDING A SENSOR

(75) Inventor: Ronald P. Bartos, Menomonee Falls, WI (US)

(73) Assignee: A.O. Smith Corporation, Milwaukee, WI (US)

( * ) Notice: Subject to any disclaimer, the term of this patent is extended or adjusted under 35 U.S.C. 154(b) by 125 days.

(21) Appl. No.: 09/925,426

(22) Filed: Aug. 9, 2001

(65) Prior Publication Data

US 2003/0031084 A1 Feb. 13, 2003

(51) Int. Cl.[7] ..... B01F 7/00; B01F 15/00; A47K 3/00; E04H 4/12

(52) U.S. Cl. ..... 366/141; 366/348; 366/349; 366/601; 4/541.2; 68/12.04; 200/85 R

(58) Field of Search ..... 68/12.04; 366/141, 366/142, 279, 349, 342; 4/492, 541.1, 541.2, 623, 621, 626, 668; 200/61.07, 85 R; 310/340; 137/81.2, 565.13

(56) References Cited

U.S. PATENT DOCUMENTS 2,381,894 A * 8/1945 Ferris ..... 68/12.07
2,926,360 A * 3/1960 Erickson et al. ..... 4/668
4,169,293 A * 10/1979 Weaver ..... 4/541.2
4,237,562 A * 12/1980 DuPont ..... 4/541.5
4,254,311 A 3/1981 Sisk, Jr.
4,401,896 A 8/1983 Fowler et al.
4,404,697 A * 9/1983 Hatcher ..... 4/496
4,581,506 A 4/1986 Bai et al.
4,618,797 A 10/1986 Cline
4,716,605 A 1/1988 Shepherd et al.
4,844,333 A * 7/1989 Davis et al. ..... 4/541.2
4,861,231 A * 8/1989 Howard ..... 4/541.2
4,947,298 A 8/1990 Stephen
5,117,233 A * 5/1992 Hamos et al. ..... 4/541.1
5,332,944 A 7/1994 Cline
5,548,854 A 8/1996 Bloemer et al.
5,974,602 A * 11/1999 Theander ..... 4/541.1
6,065,353 A 5/2000 Hirabayashi et al.
6,282,370 B1 * 8/2001 Cline et al. ..... 392/465

* cited by examiner

*Primary Examiner*—Tony G. Soohoo
(74) *Attorney, Agent, or Firm*—Michael Best & Friedrich LLP

(57) ABSTRACT

A fluid holding apparatus including a vessel capable of holding a load including a fluid and a sensor coupled to the vessel. The sensor is operable to sense the load held by the vessel and to generate a signal having a relation to the load. The fluid holding apparatus further includes a controller electrically coupled to the sensor. The controller is operable to initiate a control signal in response to a variation in the load.

56 Claims, 2 Drawing Sheets

FLUID-HOLDING APPARATUS INCLUDING A SENSOR

BACKGROUND OF THE INVENTION

The invention relates to a fluid-holding apparatus and, particularly, a fluid-holding apparatus including a sensor.

Prior fluid-holding apparatus having a fluid-moving system (e.g., spas, whirlpools, jetted tubs, swimming pools, hot tubs, clothes washing machines and similar fluid-holding apparatus) typically include manually actuated air switches for controlling the apparatus. For example, if the fluid holding apparatus is a jetted tub, then the jetted tub typically includes a controller and at least one operator-actuated switch (e.g., a jetted water ON/OFF switch.) The operator turns on the jets in the jetted tub (i.e. to cause movement to the water) by physically actuating the ON/OFF switch from an OFF position to an ON position.

SUMMARY OF THE INVENTION

It would be a beneficial convenience if some element of the fluid-holding apparatus could sense a varying weight held by the apparatus and perform an action in response to the variation in weight. For example, when a user enters the jetted tub, the change in weight in the tub could be detected, and used to automatically start the jets, thereby eliminating the need for the user to manually activate the jets using the ON/OFF switch.

Accordingly, in one embodiment of the invention, the fluid holding apparatus senses when an operator or occupant enters the apparatus and automatically activates a fluid-movement system in response to the change in weight in the apparatus. In another embodiment of the invention, the fluid holding apparatus senses when the occupant exits the apparatus and deactivates the fluid-movement system upon the exiting of the occupant. In even another embodiment of the invention, the fluid holding apparatus distinguishes whether the entering occupant is an "authorized" occupant. For example, if the entering occupant is a child, then the fluid holding apparatus senses the lighter weight of the child and provides an audio and/or visual alarm signifying that the occupant is not authorized to use the apparatus (e.g. the occupant is a child). In addition, the fluid-holding apparatus may not activate the fluid-movement system if the apparatus senses the unauthorized occupant. In yet another embodiment of the invention, the fluid-holding apparatus senses whether a significant amount of fluid has escaped or been drained from the apparatus and prevents activation of the fluid-movement system even if a user steps into the tub or the weight in the tub or apparatus increases.

The invention provides a fluid holding apparatus including a vessel capable of holding a load (e.g., a fluid such as chlorinated water), and a sensor coupled to the vessel. The sensor is operable to sense a weight of the load held by the vessel and to generate a signal having a relation to the load. The fluid holding apparatus further includes a controller electrically coupled to the sensor. The controller is operable to initiate a control signal in response to a variation in the load.

The invention further provides a fluid-movement system and controller combination connectable to a vessel that holds water. The combination includes a sensor connectable to the vessel. The sensor is operable to sense a pressure applied to the sensor and to generate a signal in response to the applied pressure. The combination further includes a controller electrically connected to the sensor. The controller is operable to receive the signal from the sensor and to initiate a control signal in response to a varying load signal. The combination further includes a motor electrically coupled to the controller. The motor is operable to receive the control signal and to generate a mechanical power in response to receiving the control signal. The combination further includes an agitator mechanically coupled to the motor. The agitator is operable to receive the mechanical power from the motor and to move the fluid in response to receiving the mechanical power. The agitator may agitate the fluid either directly or indirectly. For example, the agitator may be a mechanical member such as in a washing machine that agitates the fluid by direct mechanical contact therewith, or may be a blower or jet that forces air through the fluid thereby indirectly agitating the fluid.

The invention further provides a method of providing a control signal to an output device connectable to a fluid holding apparatus. The method includes the act of providing a fluid holding apparatus having a vessel capable of holding a load including a fluid and having a load sensor coupled to the vessel. The method further includes the acts of sensing the weight of the load held by the vessel, initiating a control signal in response to a variation in the weight, providing the control signal to the output device, and generating an output with the output device in response to the control signal.

The invention further provides a method of moving a fluid in a fluid holding apparatus. The method includes the acts of providing the fluid holding apparatus having a vessel capable of holding a load including a fluid, sensing a weight of the load held by the vessel, initiating a control signal in response to an increase variation in the weight, and moving the fluid in response to the generating of the control signal.

The invention further provides a software program stored in a computer readable medium that controls an output device of a fluid-holding apparatus. The software program includes program code for acquiring a signal, determining a first magnitude of the signal, determining a second magnitude of the signal, calculating a rate of change of the load based at least in part on the first and second magnitudes, determining if the rate of change is increasing, determining if the rate of change is greater than a specified rate of change when the rate of change is increasing, calculating a difference between the second and first magnitudes, and initiating a control signal resulting in an output from the output device when the difference is less than a specified difference.

Other features and advantages of the invention will become apparent to those skilled in the art upon review of the following detailed description, claims, and drawings.

Before any embodiments of the invention are explained in full detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including", "having", "comprising" and variations thereof herein is meant to encompass the items listed thereafter and equivalents thereof as well as additional items.

DETAILED DESCRIPTION

Figure 1:
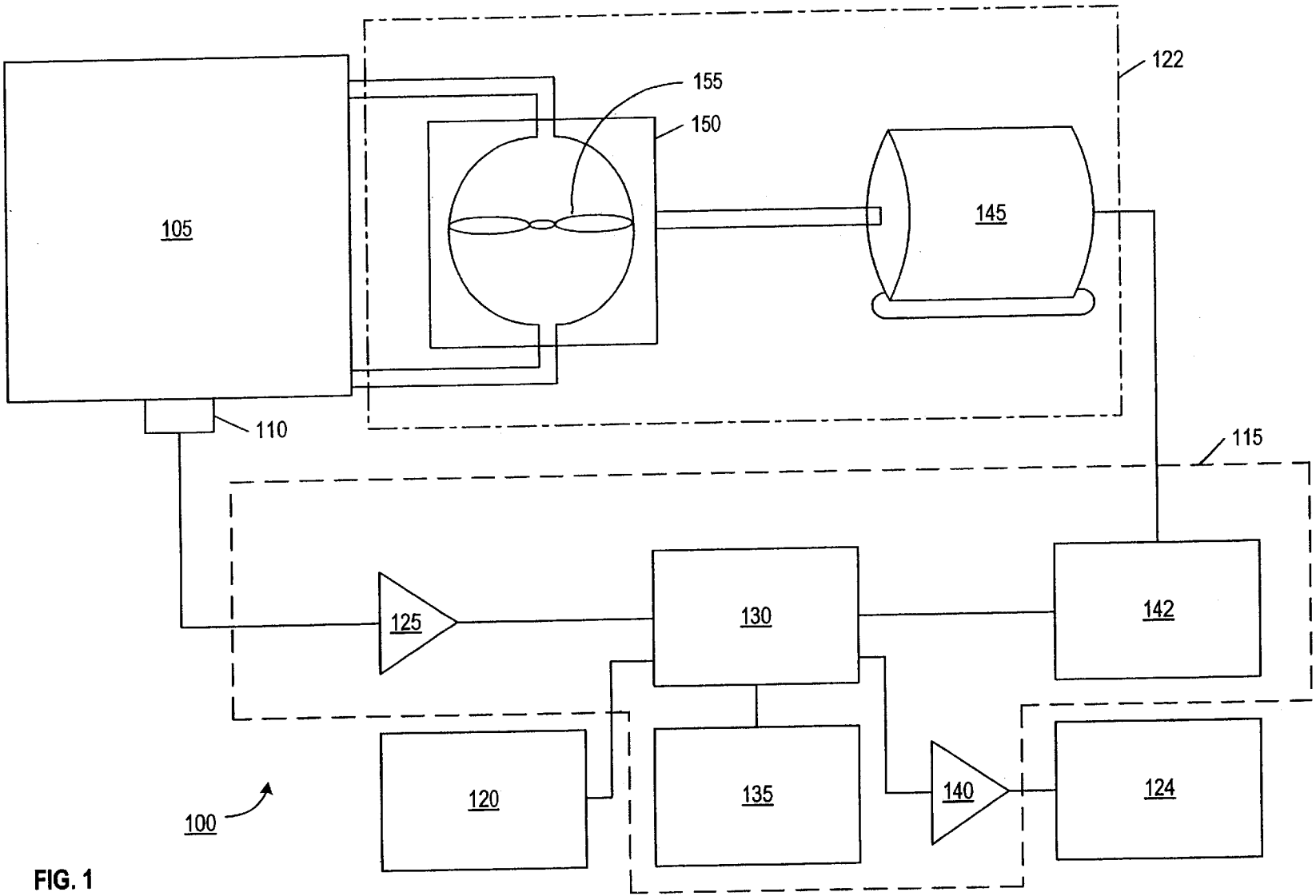
FIG. 1 is a schematic diagram of an apparatus including a fluid-movement system having a control circuit of the invention.

A fluid-holding apparatus 100 embodying the invention is schematically shown in FIG. 1. The fluid-holding apparatus 100 generally includes a vessel 105, and a control system for controlling the agitation of fluid in the apparatus. The control system generally has a sensor 110, a controller 115, an operator-controlled input device 120, and at least one output device. For the embodiment shown in FIG. 1, the output devices include a fluid-movement system 122, and a visual and/or audio output device 124. Example fluid-holding apparatus include a jetted tub, a whirlpool, a spa, a hot tub, a swimming pool, and similar fluid-holding apparatus. Furthermore, some aspects of the invention may be used in connection with other fluid-holding apparatus such as clothes washing machines, water heaters and similar fluid-holding apparatus.

In the preferred embodiment, the vessel 105 is a hollow container such as a tub or a vat that holds a load. The load includes a fluid, such as chlorinated water, and may include one or more occupants or items.

The sensor 110 is a device that responds to a physical stimulus applied to the sensor 110 and transmits a resulting signal. In one embodiment of the invention, the sensor 110 is a pressure sensor coupled to the vessel 105 such that a weight of the load is sensed. In a preferred embodiment, the pressure sensor is strategically mounted on the vessel 105 such that the sensor responds to a pressure applied to the sensor when the load held by the vessel 105 changes. As shown in FIG. 1, the pressure sensor is preferably located on the bottom of the vessel 105 so that, when an operator enters the vessel 105, force applied to the sensor changes resulting in a varying signal. In another specific example (not shown), the vessel 105 includes a brim and the pressure sensor is positioned between the brim and a fixed support structure connected to the brim. Similar to the first specific example, when an occupant enters the vessel 105, the brim compresses the sensor towards support structure resulting in a varying signal. Example pressure sensors include piezoelectric sensors, strain-gauge sensors, capacitive-load sensors or similar pressure sensors. It is envisioned that other sensors 110 may be used to sense a varying load in the vessel. In addition, it is envisioned that multiple sensors or an array of sensors may be coupled to the vessel 105.

As shown in FIG. 1, the fluid-holding apparatus 100 further includes a controller 115. The controller 115 is electrically coupled to the sensor 110 and is operable to generate one or more control signals in response to a variation of the load held by vessel 105. The controller 115 may be implemented with or include any one, all or a combination of an application-specific-integrated circuit (ASIC), a microprocessor and memory, and/or discrete circuitry.

For the embodiment shown in FIG. 1, the controller 115 includes amplifying and signal conditioning circuitry 125. The amplifying and signal conditioning circuitry 125 receives the signal from the sensor 110, and amplifies and conditions the signal to a specified voltage range (e.g., 0–5 VDC.) The amplified and conditioned signal has a relationship (e.g., a proportional relationship) to the load held by the vessel. As used herein, the term "the load held by the vessel" and variations thereof include only the load or weight within the vessel, or the load or weight within the vessel in combination with the weight of the vessel. If the signal includes the weight of the vessel, then aspects of the invention discussed below will take into account the weight of the vessel to ensure that the changing load is accurately evaluated.

The controller 115 further includes a microprocessor 130 and memory 135. The microprocessor 130 receives the amplified and conditioned signal, executes a software program for analyzing the received signal, and generates one or more control signals that control the one or more output devices (e.g., output devices 122 and 124.) The software program is stored in memory 135, which may further include data storage memory (not shown). The implementation of the software program is discussed in farther detail below. For the embodiment shown, the microprocessor 130 includes an analog-to-digital (A/D) converter and a timer (neither of which are separately shown in the drawings). However, the controller 115 may include separate circuitry for an A/D converter and separate circuitry for a timer. In addition, although only one microprocessor is shown, multiple processors may be used.

The controller 115 further includes an output amplifier 140 that receives a control signal from the microprocessor 130 and generates an output signal having the proper voltage for controlling output device 124. Of course, for some embodiments, the output amplifier 140 may not be required.

The controller 115 further includes a driver 142 that receives a control signal from the microprocessor 130 and generates a drive signal for driving or controlling the fluid-movement system 122. For example, in the embodiment shown in FIG. 1, the fluid-movement system 122 includes a pump motor (discussed below) that is controlled by a motor control circuit. In some embodiments, the driver 142 may not be required, and the fluid movement system 122 is driven directly by microprocessor 130.

As shown in FIG. 1, the operator-controlled input device 120 is connected to microprocessor 130 and provides an interface between the controller 115 and an operator. The operator-controlled input device 120 may include one or more switches, one or more push buttons, a touch screen, a voice-data input system, and/or similar input devices allowing an operator to manually input a command into the controller 115. The operator-controlled input device 120 may further include a master on/off switch that directly activates or deactivates one or more elements of the fluid holding apparatus 100.

The fluid-movement system 122 moves the fluid held by the vessel 105 in response to a drive signal or a control signal from the driver 142 and microprocessor 130. For the fluid-movement system 122 shown in FIG. 1, the system 122 includes a pump motor 145 that receives a current from the controller 142. As is commonly known in the art, the pump motor 145 converts the electrical energy of the drive signal into mechanical energy. The pump motor 145 may be any motor including a direct-current motor, a single-phase alternating-current motor or a three-phase alternating-current motor. The mechanical energy is applied to an agitator resulting in movement of the fluid. For the embodiment shown, the agitator is a water pump for injecting jetted fluid into the vessel 105. In a preferred embodiment, the pump 150 includes an impeller 155 that controllably moves the fluid of the vessel 105 through the pump. Other fluid-movement systems having other agitators may be used without departing from the spirit of the invention. For example, the pump 150 may be connected to a frame that operates to inject jetted air into the fluid. In still another example, the motor 145 may be connected to a mechanical agitator such as in a washing machine.

The visual and/or audio output device 124 receives a control signal from the controller 115 and produces an output (e.g., a visual and/or audio output) in response to the control signal. Example visual output devices include one or more light sources (e.g., incandescent lights, LEDs, etc.), one or more displays (e.g., LCDs), or similar visual display devices. Example audible output devices include a speaker, or one or more tone-producing devices. Additionally, other output devices may be added to receive the control signal from the controller 115. For example, the output device may be a valve controller that controls a valve upon receiving the control signal (e.g., to release the fluid from the vessel during an emergency state). Other actions performed by the elements discussed above will become apparent in the description of the operation below.

Figure 2:
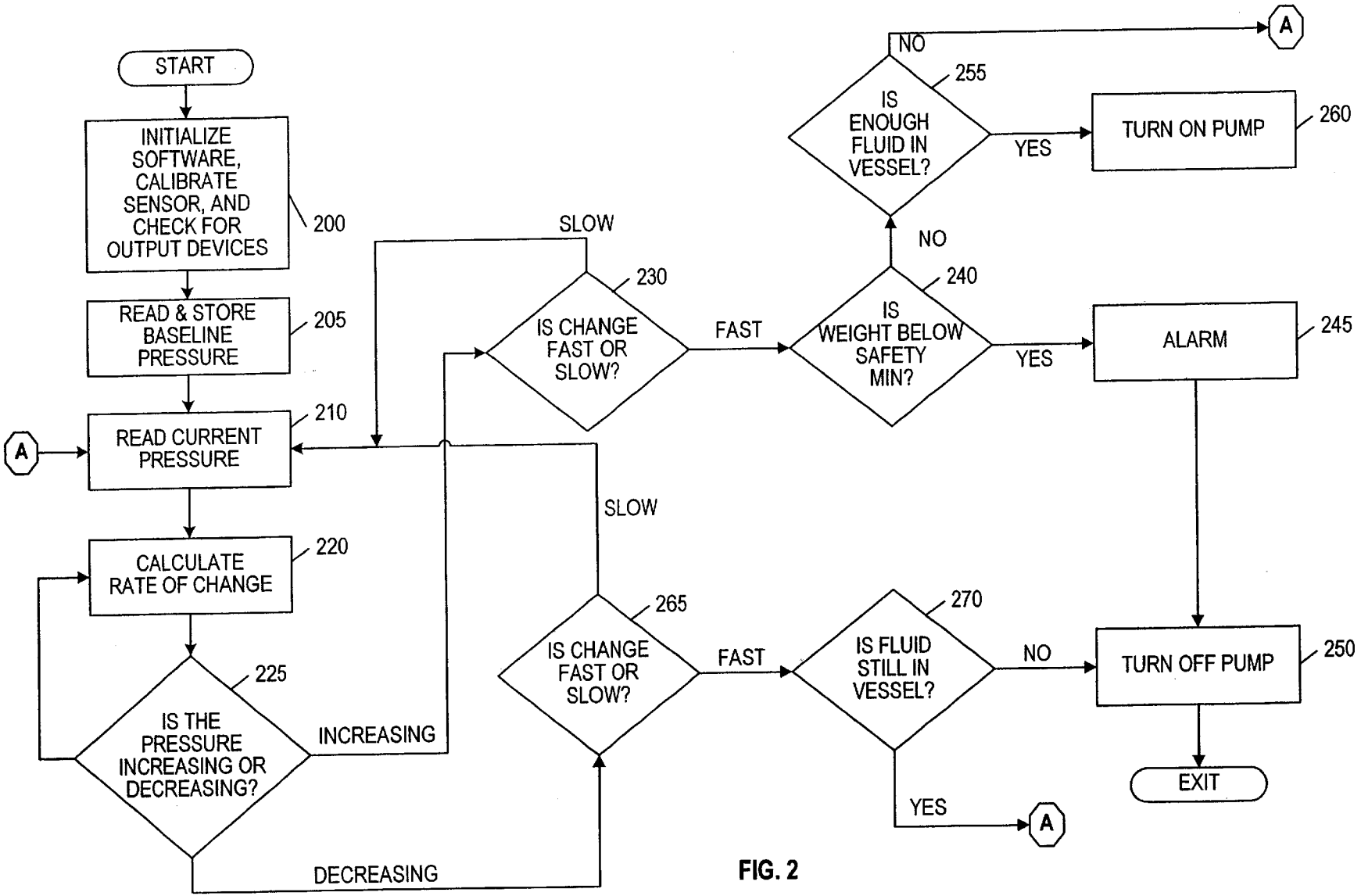
FIG. 2 is a flowchart implementing a method of controlling an apparatus including a fluid-movement system having a control circuit of the invention.

In operation and as shown in FIG. 2, an operator or technician activates the controller 115 by turning ON the master ON/OFF switch at the operator-controlled input device 120. Upon activating the controller 115, the microprocessor 130 obtains, interprets and executes a software program stored in memory 135.

Specifically, the software initializes all variables (act 200), calibrates the sensor 110, and validates or checks for output devices 122 and 124 (act 200). At act 205, the microprocessor 130 acquires and stores a baseline signal from the sensor 110. The baseline signal represents a nominal weight of the vessel 105 and is a baseline pressure sensed by the pressure sensor. At act 210, the microprocessor 130 acquires or reads a current pressure sensed by the pressure sensor. Upon acquiring a current pressure, the software calculates a rate of change of the signal or weight (act 220). The rate of change may be calculated by subtracting the current pressure for a previously sensed pressure and dividing by a time period. However, other more complicated methods may be used to calculate a rate of change.

At act 225, the software determines whether the pressure is increasing or decreasing. This may be performed by analyzing the rate of change or by comparing the current pressure with the previously sensed pressure. If the pressure is increasing, then the software proceeds to act 230. If the pressure is decreasing, then the software proceeds to act 265.

At act 230, the software determines whether the calculated rate of change signifies a fast or slow rate of change. This may be performed by determining whether the calculated rate of change is greater than or less than a specified or predetermined value. If the rate of change signifies a slow rate of change, then the software returns to act 210. If the rate of change signifies a fast rate of change, then the software proceeds to act 240 to perform further analysis.

At act 240, the software determines whether the increased load is above or below a specified or predetermined amount. For example, the software may subtract the current pressure from the previously sensed pressure. If the difference between the two values is less than a specified value, then an alarm occurs (act 245). For a specific example, if the difference between the two sensed values represents a weight change of less than fifty pounds, then an alarm sounds signifying a child or animal has entered the vessel 105. For another specific example and for the embodiment shown, the software may subtract the current pressure from the baseline pressure and compare the difference to a specified amount (e.g., less than fifty pounds.) If the difference is less than the specified amount (e.g., an unsupervised child enters the vessel 105) then an alarm occurs (act 245) and the pump is turned off (act 250.) If the child is being supervised but the adult has not entered the tub, then the adult may override the alarm by entering a code into the input device 120.

If the load is above the minimum safety weight, then the software proceeds to act 255. At act 255, the software determines whether there is enough fluid in the vessel 105 to properly agitate or move the fluid. If enough fluid is present, then the microprocessor 130 generates a control signal that is applied to the driver 142. The driver 142 creates a drive signal that is applied to the fluid-movement system 122 for moving the fluid. Specifically, the drive signal is applied to the pump motor 145, resulting in the motor producing mechanical energy. The mechanical energy is applied to the impeller 155 of the pump 150. The pump 150 cycles the fluid within the vessel 105 and produces jetted water.

Of course, the mechanical energy may be applied differently for other agitators. For example and as stated above, the fluid-holding apparatus may be a clothes washing machine, the agitator may be a paddle, and the agitator may move the water as is known in the art of clothes washing machines. In this context, the software may determine the weight of the clothes within the vessel 105 and only activate the agitator if the clothes are within a weight limit. For example, the load may be too large for the washer to perform properly.

Referring back to act 225, the software determines whether the pressure (i.e., the load within the vessel 105) is increasing or decreasing. If the pressure is decreasing, then the software proceeds to act 265. At act 265, the software determines whether the calculated rate of change signifies a fast or slow rate of change. If the rate of change signifies a slow rate of change, then the water proceeds to act 270. If the rate of change signifies a fast rate of a change, then the software proceeds to act 275.

At act 270, the software determines whether there is enough fluid within the vessel to properly agitate or move the fluid. If too little fluid is within the vessel 105, then the pump 150 may overheat. Determining whether enough fluid is within the vessel may be performed by subtracting the baseline pressure from the current pressure. If the difference between the two values is larger than a specified or predetermined value, then the controller 115 turns off the pump (act 250). Otherwise, the software returns to act 210.

At act 275, the software determines whether the rate of change is caused by a rapid escape of fluid. This may be performed by subtracting the baseline pressure from the current pressure. If the difference between the two values is larger than a specified or predetermined value, then the controller 115 turns off the pump 150 (act 250). Alternatively, the software may determine whether the change is caused by an operator exiting the tub. This may be performed by subtracting the previously sensed pressure from the current pressure. If the difference between the two values is larger than a specified or predetermined value, then the controller 115 may turn off the pump 150 (act 250). Of course, if a fast rate of change is sensed at act 265, then the software may proceed directly to act 250.

As can be seen from the above, the invention provides a useful fluid-holding apparatus including a sensor. In addition, the invention provides a useful method of and useful software program for controlling a fluid-holding apparatus. Various features and advantages of the invention are set forth in the following claims.

What is claimed is:

1. A fluid holding apparatus comprising:

a vessel capable of holding a load including a fluid;

a sensor coupled to the vessel, the sensor being operable to sense a weight of the load and to generate a load signal having a relation to the load;

a controller electrically coupled to the sensor and being operable to controllably generate a control signal in response to a variation in the load; and a fluid-movement system coupled to vessel, the fluid-movement system includes a fluid agitator and a motor connected to the fluid agitator, the fluid-movement system being operable to receive the control signal and cause the fluid-movement system to move the fluid in response to receiving the control signal.

2. A fluid holding apparatus as set forth in claim 1 wherein the sensor includes a piezoelectric sensor.

3. A fluid holding apparatus as set forth in claim 1 wherein the sensor includes a strain-gauge sensor.

4. A fluid holding apparatus as set forth in claim 1 wherein the sensor includes a capacitive-load sensor.

5. A fluid holding apparatus as set forth in claim 1 wherein the fluid agitator includes a pump, and wherein the motor is a pump motor.

6. A fluid holding apparatus as set forth in claim 1 wherein the fluid agitator includes an impeller and wherein the control signal causes the impeller to move to force jetted water into the vessel.

7. A fluid holding apparatus as set forth in claim 1 wherein the controller includes a microprocessor electrically coupled to the sensor, and wherein the microprocessor controllably generates the control signal in response to the variation in the load.

8. A fluid holding apparatus as set forth in claim 7 wherein the controller further includes a driver electrically coupled to the microprocessor and the motor, wherein the control signal is transmitted from the microprocessor to the driver, wherein the driver generates a drive signal in response to the control signal, and wherein the drive signal controls the motor.

9. A fluid holding apparatus as set forth in claim 1 wherein the controller includes an application-specific-integrated circuit (ASIC) electrically coupled to the sensor, and wherein the ASIC controllably generates the control signal in response to the variation in the load.

10. A fluid holding apparatus as set forth in claim 1 wherein the apparatus further comprises an input device, wherein the input device is operable to receive an operator input, wherein the controller is operable to controllably generate a second control signal in response to the operator input, and wherein the second control signal causes the fluid-movement system to move the water.

11. A fluid holding apparatus as set forth in claim 1 wherein the apparatus further comprises an output device electrically coupled to the controller, and wherein the output device is operable to receive the control signal and to generate an output in response to receiving the control signal.

12. A fluid holding apparatus as set forth in claim 11 wherein the output device includes an audible output device, and wherein the output includes an audible output.

13. A fluid holding apparatus as set forth in claim 11 wherein the output device includes a visual output device, and wherein the output includes a visual output.

14. A fluid holding apparatus as set forth in claim 11 wherein the output device includes a valve controller, and wherein the output includes an opening of the valve.

15. A fluid holding apparatus as set forth in claim 11 wherein the output device includes a motor, and wherein the output includes a mechanical power.

16. A fluid holding apparatus as set forth in claim 1 wherein the apparatus further comprises an input device, wherein the input device is operable to receive an operator input and wherein the controller is operable to controllably generate a second control signal in response to the operator input.

17. A fluid holding apparatus as set forth in claim 1 wherein the fluid holding apparatus is a swimming pool.

18. A fluid holding apparatus as set forth in claim 1 wherein the fluid holding apparatus is a hot tub.

19. A fluid holding apparatus as set forth in claim 1 wherein the fluid holding apparatus is a spa.

20. A fluid holding apparatus as set forth in claim 1 wherein the fluid holding apparatus is a whirlpool.

21. A fluid holding apparatus as set forth in claim 1 wherein the fluid holding apparatus is a clothes washing machine.

22. A fluid holding apparatus as set forth in claim 1 wherein the controller controllably generates the control signal by acquiring a first magnitude of the load signal, acquiring a second magnitude of the load signal, calculating a difference value with the first and second magnitudes, and controllably generating the control signal when the difference value is greater than a specified value.

23. A fluid holding apparatus as set forth in claim 1 wherein the controller controllably generates the control signal by acquiring a first magnitude of the load signal, acquiring a second magnitude of the load signal, calculating a rate of change of the load signal with the first and second magnitudes, and controllably generating the control signal when the rate of change is greater than a specified value.

24. A control system for controlling the agitation of fluid in a vessel, the control system comprising:

a sensor operable to sense a pressure applied to the sensor and to generate a load signal having a relation to the applied pressure;

a controller electrically connected to the sensor, the controller being operable to receive the load signal and to controllably generate a control signal in response to the load signal varying by an amount in a time period;

a motor electrically coupled to the controller, the motor being operable to receive the control signal and to generate mechanical power in response to receiving the control signal; and an agitator mechanically coupled to the motor and being operable to move the fluid in response to the mechanical power generated by the motor.

25. A control system as set forth in claim 24 wherein the sensor includes a piezoelectric sensor.

26. A control system as set forth in claim 24 wherein the sensor includes a strain-gauge sensor.

27. A control system as set forth in claim 24 wherein the sensor is includes a capacitive load sensor.

28. A control system as set forth in claim 24 wherein the agitator includes a pump, and wherein the motor is a pump motor.

29. A control system set forth in claim 24 wherein the agitator includes at least one impeller and wherein the impeller forces jetted water into the vessel.

30. A control system as set forth in claim 24 wherein the controller includes a microprocessor electrically coupled to the sensor, and wherein the microprocessor controllably generates the control signal in response to the varying load signal.

31. A control system as set forth in claim 30 wherein the controller further includes a driver electrically coupled to the microprocessor and the motor, wherein the control signal is transmitted from the microprocessor to the driver, wherein the driver generates a drive signal in response to the control signal, and wherein the drive signal controls the motor.

32. A control system as set forth in claim 24 wherein the controller includes an application-specific-integrated circuit (ASIC) electrically coupled to the sensor, and wherein the ASIC controllably generates the control signal in response to the varying load signal.

33. A method of providing a control signal to an output device connectable to a fluid holding apparatus, the method comprising the acts of:

providing a fluid holding apparatus having a vessel capable of holding a load including a fluid;

providing a load sensor coupled to the vessel;

sensing a pressure applied to the load sensor;

generating a load signal having a relation to the applied pressure;

acquiring a first magnitude of the load signal;

acquiring a second magnitude of the load signal;

calculating a difference between the first and second magnitudes;

controllably generating a control signal when the difference is greater than a limit;

providing the control signal to the output device; and generating an output with the output device in response to the provided control signal.

34. A method as set forth in claim 33 wherein the output device is includes a fluid agitator, and wherein the act of generating an output includes the act of generating a mechanical output resulting in movement of the fluid.

35. A method as set forth in claim 33 wherein the output device is includes a display device, and wherein the act of generating an output includes the act of generating a visual output with the display device.

36. A method as set forth in claim 33 wherein the output device is includes an audio device, and wherein the act of generating an output includes the act of generating an audible output.

37. A method as set forth in claim 33 wherein the load signal signifies a weight of the load.

38. A method as set forth in claim 33 wherein the difference between the first and second magnitudes is an absolute difference between the first and second magnitudes.

39. A method as set forth in claim 33 wherein the output device includes a fluid agitator, and wherein the act of generating an output includes the act of ceasing the generation of a mechanical output by the fluid agitator.

40. A method comprising the acts of:

providing a fluid holding apparatus having a vessel capable of holding a load including a fluid;

sensing a weight of the load held by the vessel;

controllably initiating a control signal in response to a variation in the weight; and moving the fluid in response to the initiating of the control signal.

41. A method as set forth in claim 40 wherein the act of sensing the weight of the load includes the acts of providing a sensor, sensing a pressure applied to the sensor, the pressure having a relation to the weight, and generating a load signal having a relation to the applied pressure.

42. A method as set forth in claim 41 wherein the act of generating a control signal in response to a variation in the weight includes the acts of acquiring a first magnitude of the load signal, acquiring a second magnitude of the load signal, calculating a difference between the second magnitude and the first magnitude, and initiating the control signal when the difference is greater than a specified limit.

43. A method as set forth in claim 40 and further comprising:

after the act of moving the fluid in response to the initiating of a first control signal, initiating a second control signal in response to a decrease in the weight;

and ceasing movement of the fluid in response to the initiating of the second control signal.

44. A method as set forth in claim 43 wherein the act of sensing the weight of the load includes sensing a pressure applied to a sensor, the pressure having a relation to the weight, and generating a load signal having a relation to the applied pressure.

45. A method as set forth in claim 43 wherein the act of initiating a second control signal in response to a decrease in the weight includes the acts of acquiring a first magnitude of the load signal, acquiring a second magnitude of the load signal, calculating a difference between the first magnitude and the second magnitude, and initiating the control signal when the absolute difference is greater than a specified limit.

46. A fluid holding apparatus comprising:

a vessel capable of holding a load including a fluid;

a sensor coupled to the vessel, the sensor being operable to sense a weight of the load and to generate a load signal having a relation to the load;

a controller electrically coupled to the sensor and being operable to controllably generate a control signal in response to the load signal varying by an amount in a time period.

47. A fluid holding apparatus as set forth in claim 46 wherein the controller controllably generates the control signal by acquiring a first magnitude of the load signal, acquiring a second magnitude of the load signal at a period after acquiring the first load signal, calculating a difference value with the first and second magnitudes, and controllably generating the control signal when the difference value is greater than a specific value.

48. A fluid holding apparatus as set forth in claim 46 wherein the controller controllably generates the control signal by acquiring a first magnitude of the load signal, acquiring a second magnitude of the load signal at a period after acquiring the first load signal, calculating a rate of change of the load signal with the first and second magnitudes, and controllably generating the control signal when the rate of change is greater than a specified value.

49. A fluid holding apparatus comprising:

a vessel capable of holding a load including a fluid;

a sensor coupled to the vessel, the sensor being operable to sense a pressure applied to the sensor and to generate a load signal having a relation to the applied pressure;

a controller electrically coupled to the sensor and being operable to controllably generate a control signal in response to the load signal varying by an amount in a time period.

50. A method of providing a control signal to an output device connectable to a fluid holding apparatus, the method comprising the acts of:

providing a fluid holding apparatus having a vessel capable of holding a load including a fluid;

providing a load sensor coupled to the vessel;

generating a load signal having a relation to the load;

acquiring a first magnitude of the load signal;

acquiring a second magnitude of the load signal;

calculating a rate of change of the load signal based on the first and second magnitudes;

controllably generating a control signal when the rate of change is greater than a specified rate of change;

providing the control signal to an output device; and generating an output with the output device in response to the provided control signal.

51. A method as set forth in claim 50 wherein the controllably generating act includes the act of controllably generating a control when the rate of change is increasing.

52. A method as set forth in claim 50 wherein the output device includes a fluid agitator, and wherein the act of generating an output includes the act of generating a mechanical output with the fluid agitator resulting in movement of the fluid.

53. A method as set forth in claim 50 wherein the controllably generating act includes the act of controllably generating a control signal when the rate of change is decreasing.

54. A method as set forth in claim 50 wherein the output device includes a fluid agitator, and wherein the act of generating an output includes the act of ceasing the generation of a mechanical output by the fluid agitator.

55. A method as set forth in claim 50 wherein the load signal signifies a weight of the load.

56. A method as set forth in claim 50 wherein generating a load signal includes the acts of sensing a pressure applied to the load sensor, and generating a load signal having a relation to the applied pressure.

* * * * *